US006764416B1

(12) United States Patent
Hicks

(10) Patent No.: US 6,764,416 B1
(45) **Date of Patent: *Jul. 20, 2004**

(54) USING HAND-HELD AMUSEMENT DEVICE

(76) Inventor: Michael J. Hicks, 821 Dan River Rd., Spartanburg, SC (US) 29307

( * ) Notice: Subject to any disclaimer, the term of this patent is extended or adjusted under 35 U.S.C. 154(b) by 0 days.

This patent is subject to a terminal disclaimer.

(21) Appl. No.: 10/233,936

(22) Filed: Sep. 4, 2002

Related U.S. Application Data

(63) Continuation-in-part of application No. 09/728,901, filed on Dec. 4, 2000, now Pat. No. 6,537,163.
(60) Provisional application No. 60/180,147, filed on Feb. 4, 2000.

(51) Int. Cl.[7] ..... A63B 59/02
(52) U.S. Cl. ..... 473/509
(58) Field of Search ..... 473/509, 515, 473/514, 513

(56) References Cited

U.S. PATENT DOCUMENTS 3,069,805 A * 12/1962 Burrows ..... 446/124
3,445,551 A * 5/1969 Griffin ..... 264/21
4,045,027 A * 8/1977 Manska ..... 473/509
4,863,174 A * 9/1989 Cummings ..... 473/509
5,597,185 A * 1/1997 Bray et al. ..... 285/179
6,537,163 B2 * 3/2003 Hicks ..... 473/509

FOREIGN PATENT DOCUMENTS

DE 20100034 U1 * 11/2001 ..... A63H/33/18

* cited by examiner

*Primary Examiner*—Gregory Vidovich
*Assistant Examiner*—M. Chambers
(74) *Attorney, Agent, or Firm*—Richard L Huff

(57) ABSTRACT

A method of playing with a ball and a U-shaped conduit having a uniform circular cross-section throughout its length and having opposite open ends so that either open end can discharge or capture the ball. The method comprises: holding the conduit so that the open ends are upright and the ball is in the center of the conduit, starting the ball moving back and forth by moving the conduit sidewise, as the ball rolls inside the conduit, moving the conduit in the opposite direction creating momentum on the ball so that it will travel farther up the opposite side of the conduit, and repeating the above steps until the ball is released from the conduit through an open end. The method may be carried out by a single player who repeatedly releases and captures the ball or by multiple players who take turns capturing and releasing the ball.

6 Claims, 2 Drawing Sheets

USING HAND-HELD AMUSEMENT DEVICE

REFERENCE TO RELATED APPLICATIONS

This application is a continuation-in-part of my application, Ser. No. 09/728,901, now U.S. Pat. No. 6,537,163 filed Dec. 4, 2000, which, in turn, claims the benefit of Provisional Application No. 60/180,147 filed Feb. 4, 2000.

BACKGROUND OF THE INVENTION

1. Field of the Invention

The present invention relates generally to toys. More particularly, the invention comprises a hand-held amusement device that consists of an aerial projectile and a U-shaped hollow conduit which, when properly manipulated by a player, will discharge and receive the aerial projectile, so as to keep the projectile in a continuous play mode.

2. Description of the Related Art

The most closely related prior art known by the inventor is a ball catcher and thrower disclosed in U.S. Pat. No. 4,863,174 and issued to Gerald W Cummings on Sep. 5, 1980. The patented device is a hand-held catching and throwing device for maintaining an aerial projectile, such as a ball, in continuous flight or motion. The device includes an elongated, rigid, transparent double-ended tube providing a passage for receiving and projecting a projectile at or from either end, and a scoop-shaped throwing and catching member attached to each end of the tubular member and having a curved surface over which the projectile may be directed at or from an open end of the tubular member by baton-like manipulation. The patented device is made of multiple pieces, and is thus more expensive than necessary to manufacture. In use, the patented device requires relatively sharp changes in direction of the projectile, thus causing changes in speed. Also, the proper use of the patented device requires the player to use the same motion used by baton twirlers. This motion is not mastered by all players and the enjoyment of this device is thereby limited to those who have mastered this skill.

SUMMARY OF THE INVENTION

The present invention is an improvement over the known prior art in that it consists of a hand-held amusement device being an eye-hand co-ordination game which includes a U-shaped hollow conduit having openings at opposite ends. The present invention is less expensive to manufacture than the device of the above-cited prior art and there are no sharp changes of direction for the projectile. The device of the present invention will maintain an aerial projectile, such as a ball, in continuous flight or motion for fun, enjoyment, and healthful exercise when properly manipulated by a player. No special skill or training is necessary for enjoyment of this device as simple clockwise/counterclockwise movement is used. Thus, virtually everyone can enjoy the device of the present invention.

The present invention uses a hand-held amusement device that comprises an aerial projectile and an elongated hollow conduit having an opening at each end and formed into a U-shaped configuration. When the U-shaped conduit is properly manipulated by a player, in a clockwise or counterclockwise movement, the projectile will be projected out of one open end and captured by the other open end, thereby keeping the projectile in continuous play. The invention provides for a game of skill for use and enjoyment by players of all age groups and all skill levels.

The invention is simple, easy to use and is economical to manufacture. The invention provides improved elements and arrangements thereof in an apparatus for the purposes described which is inexpensive, dependable and fully effective in accomplishing its intended purpose.

Other objects, advantages and capabilities of the invention will become apparent from the following description taken in conjunction with the accompanying drawing showing the preferred embodiment of the invention.

DESCRIPTION OF THE PREFERRED EMBODIMENTS

Figure 1:
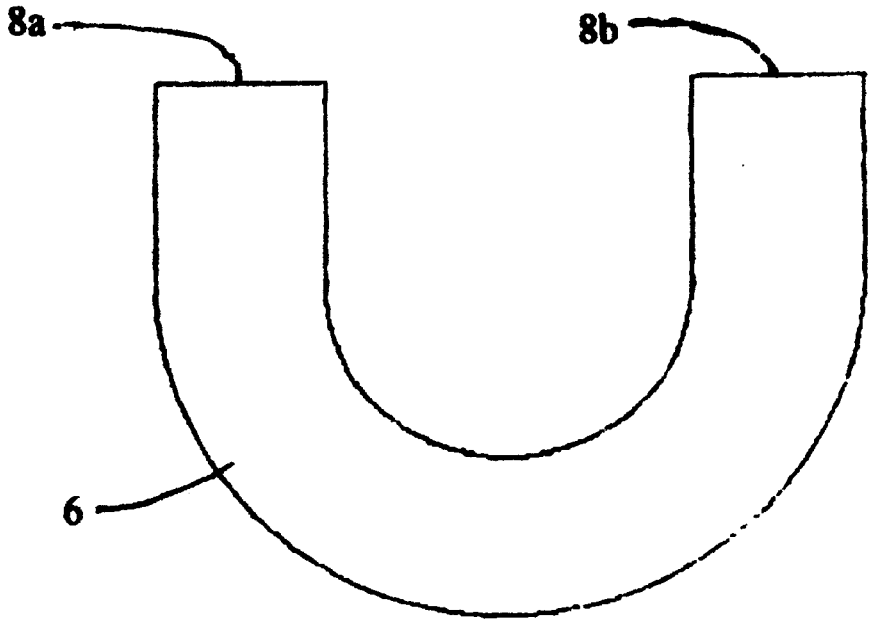
FIG. 1 is an elevational view of the U-shaped hollow conduit used in the present invention.
Figure 2:
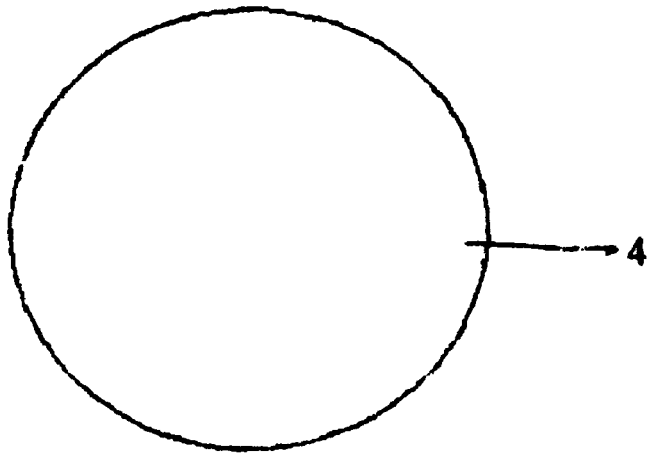
FIG. 2 is an elevational view of the ball of the present invention.
Figure 3:
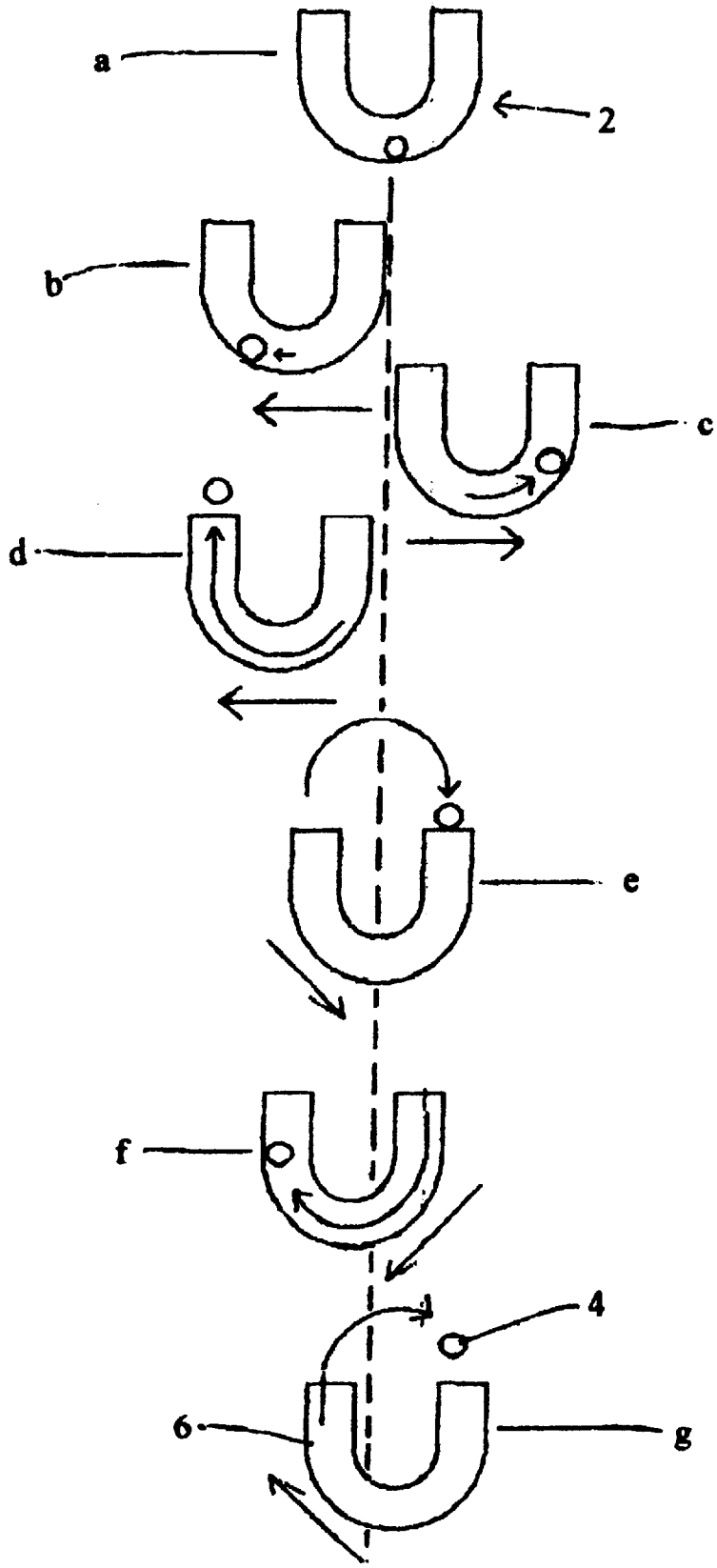
FIGS. 3*a* through 3*g* are various elevational views showing how the conduit may be used to keep the ball in continuous movement.

For a fuller understanding of the nature and desired objects of this invention, reference should be made to the following detailed description taken in connection with the accompanying drawings. Referring to the drawings wherein like reference numerals designate corresponding parts throughout the several Figures, reference is made to FIGS. 1 through 3*g* which illustrate various components of the toy used in the present invention, which toy is a hand-held amusement device 2 comprising an aerial projectile 4 and a curved conduit 6 having opposite openings 8*a,* 8*b* so that one open end 8*a* can discharge the aerial projectile 4 while the other open end 8*b* can receive the aerial projectile 4. Proper manipulation of the curved conduit 6 by a player in a clockwise/counterclockwise movement will keep the aerial projectile 4 in a continuous play mode.

Preferably, the aerial projectile 4 is a ball and the curved conduit 6 is a hollow conduit formed into a U-shaped configuration. Preferably, the U-shaped conduit 6 has a uniform circular cross-section throughout its length forming a tube and a diameter sufficiently larger than the diameter of the ball 4, to allow the ball 4 to readily pass therethrough. However, the conduit 6 may have a cross-sectional configuration which is other than circular. For instance, it may be square, triangular, oval or hexagonal. Preferably, the ball 4 glows so that enjoyment may be had at night. The ball 4 may be made to glow by the use of a luminescent coating or by the insertion of a chemoluminescent light stick into a translucent ball 4. Chemoluminescent light sticks are available in the art and are described in U.S. Pat. No. 4,878,674 to Newcomb et al.

The U-shaped conduit 6 is preferably made of a flexible material, such as soft plastic or rubber and may also be made of a non-flexible material, such as hard plastic or metal. In addition, the conduit 6 may be manufactured out of a transparent material, whereby the position of the ball 4 in the conduit 6 is visible.

The U-shaped conduit 6 is typically about three feet long and preferably about four inches in diameter. The conduit 6 is bent in a way so that both open ends 8*a,* 8*b* are in an upright position. The best size of the ball 4 is about one and seven eighths inches in diameter, being about half the size of the open ends 8*a,* 8*b*. To create more of a challenge, the conduit 6 can have a smaller diameter, thereby requiring increased skill on the part of the player.

In use, the player holds the conduit 6 with both hands so that the open ends 8*a,* 8*b* are upright and the ball 4 is in the center of the conduit 6, as shown in FIG. 3*a*. The player starts the ball 4 moving back and forth by moving the conduit 6 to the left or right, as shown in FIG. 3*b*. As the ball 4 starts to roll a few inches inside the conduit 6, the player moves the conduit 6 in the opposite sirection, as shown in FIG. 3*c*. This creates momentum on the ball 4 so that it will travel farther up the opposite side of the conduit 6. The player repeats the above steps until the ball 4 leaves the conduit 6 through the first open end 8*a,* as shown in FIG. 3*d*. When the ball 4 projects out of the conduit 6, the player captures it in an open end 8*a,* 8*b,* only to release it again, as shown in FIGS. 3*e,* 3*f,* and 3*g*.

The ball 4 can be caught with an open end 8*a,* 8*b* where it was released, by reversing the direction of movement of the conduit 6 from a clockwise to a counterclockwise direction. Timing is a great factor in continuous play. When the ball 4 makes contact with the conduit 6, the player drops the conduit 6 down to allow for a soft landing therein. As the ball 4 reaches the middle of the conduit 6, the player pumps the hands by dropping, then lifting, as the ball 4 rolls into the center, giving it more momentum to leave the conduit 6 again.

Multiple players add more challenge to the game by passing the ball 4 to and from one another. At the same time, more than one ball 4 can be used. For example, four or five players with their own conduits 6 can use two or three balls 4 to keep them all in the air without dropping one.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A method of playing with a toy, which toy comprises:

an aerial projectile and a U-shaped conduit having a uniform circular cross-section throughout its length and having opposite open ends so that either open end can discharge the aerial projectile therefrom and either open end can receive the aerial projectile therein, which method comprises:

holding the conduit so that the open ends are upright and the ball is in the center of the conduit, starting the ball moving back and forth by moving the conduit sidewise to the left or right, as the ball starts to roll a few inches inside the conduit, moving the conduit in the opposite direction creating momentum on the ball so that it will travel farther up the opposite side of the conduit, and repeating the above steps until the ball is released from the conduit through an open end.

2. The method of claim 1, wherein the conduit is held with both hands.

3. The method of claim 1, wherein the released ball is captured by an open end of the conduit.

4. The method of claim 3, wherein the steps of releasing and capturing are repeated.

5. The method of claim 1, wherein there are multiple players, each player having one toy and each player catches and releases the ball.

6. The method of claim 5, wherein there are multiple balls.

* * * * *